US007640616B2

(12) United States Patent
Peterson

(10) Patent No.: US 7,640,616 B2
(45) Date of Patent: Jan. 5, 2010

(54) MOP WITH INTEGRAL MOP HEAD WRINGING MECHANISM

(76) Inventor: Brian Wesley Peterson, 8927 Commercial Street, New Minas, Nova Scotia (CA) B4N 3E1

( * ) Notice: Subject to any disclaimer, the term of this patent is extended or adjusted under 35 U.S.C. 154(b) by 814 days.

(21) Appl. No.: 11/269,065

(22) Filed: Nov. 8, 2005

(65) Prior Publication Data

US 2007/0101526 A1 May 10, 2007

(51) Int. Cl.
*A47L 13/20* (2006.01)

(52) U.S. Cl. ..... 15/120.2; 15/119.1

(58) Field of Classification Search ..... 15/119.1, 15/120.1, 120.2
See application file for complete search history.

(56) References Cited

U.S. PATENT DOCUMENTS 1,218,618 A * 3/1917 Bauer ..... 15/120.1
1,419,543 A * 6/1922 Craib et al. ..... 15/120.2
1,710,190 A * 4/1929 Regan ..... 15/120.2
2,042,892 A * 6/1936 Granger ..... 15/120.2
2,066,096 A * 12/1936 Currie ..... 15/120.2
2,230,101 A * 1/1941 Bakemeier ..... 15/120.2
2,365,437 A * 12/1944 Schaefer ..... 15/120.2
4,464,807 A * 8/1984 Weiss ..... 15/119.2
5,722,105 A * 3/1998 Thomasson ..... 15/120.2
5,890,253 A * 4/1999 Morad ..... 15/120.1
5,907,883 A * 6/1999 Thomasson ..... 15/120.2
6,526,617 B1 * 3/2003 Dingert ..... 15/120.2

* cited by examiner

*Primary Examiner*—David B Thomas
(74) *Attorney, Agent, or Firm*—Raymond M. Galasso; David O. Simmons; Galasso & Associates LP

(57) ABSTRACT

A mop head wringing mechanism comprises a first sleeve having a helical-shaped spline extending at least partially around an external face thereof and a second sleeve is slideably engaged over the first sleeve. The second sleeve has a spline engaging portion in constrained engagement with the helical-shaped spline of the first sleeve whereby translation of the second sleeve with respect to the first sleeve causes rotation of the second sleeve with respect to the first sleeve. A slip member is substantially constrained from lateral movement with respect to the second sleeve and is engaged with the second sleeve for enabling rotation of the second sleeve relative to the slip member. A control member is coupled to the slip member such that movement of the control member causes the second sleeve to translate from an at-rest position to a displaced position thereby rotating the second sleeve with respect to the first sleeve.

14 Claims, 3 Drawing Sheets

MOP WITH INTEGRAL MOP HEAD WRINGING MECHANISM

FIELD OF THE DISCLOSURE

The disclosures made herein relate generally to mops and, more particularly, to mops including an integral mop head wringing mechanism.

BACKGROUND

Numerous types of floor-mopping apparatuses have been devised over the years. Generally speaking, they allow the user to stand upright while placing the cleaning element of the mopping apparatus in contact with a floor surface. Accordingly, such floor-mopping apparatuses are intended to provide a labor-saving and effort-reducing approach to cleaning a floor on one's hands and knees with a sponge, cloth and/or brush.

The present invention relates specifically to string mops with an integral mop head wringing mechanism. A string mop includes a mop head having a plurality of cotton or synthetic strings, or non-woven strips attached to a mop head for absorbing fluids and for cleaning the floor surface. Alternatively, the plurality of strings may be replaced with a single, soft cloth, which has general configuration and conformability similar to that of the plurality of strings.

The integral mop head wringing mechanisms of known string mops remove water and other absorbed liquids from the strings of the mop head by squeezing the strings. Depending on the specific configuration of such known mop head wringing mechanisms, wringing of the strings of the mop head is facilitated by a twisting action or by opposing members that compress the strings therebetween.

Known mop head wringing mechanisms suffer from one or more drawbacks. One drawback is that some known mop head wringing mechanisms require manual twisting of the mop head or mop head engaging device. This requirement for such manual twisting potentially puts a person's hands in contact with contaminants that the mop has removed from the floor and can require a person to exert an undesirable amount of hand strength to wring the mop head. Another drawback is that some known mop head wringing mechanisms require separate actions for moving the mop head from a use position to a wringing position and then from the wringing position to a wringed position. Such a requirement complicates wringing the mop head. Still another drawback is that some known mop head wringing mechanisms incorporate a bulky and/or complex device having opposing members that compress the strings of the mop head therebetween. Such a bulky and/or complex device detracts from the simplicity of a mop and adds to the physical size of a mop.

Therefore, a mop head wringing mechanism for a string mop that overcomes drawbacks associated with conventional mop head wringing mechanisms would be useful and advantageous.

SUMMARY OF THE DISCLOSURE

Embodiments of the present invention relate to a mop head wringing mechanism for a string mop. More specifically, embodiments of the present invention provide for a mod head wringing mechanism that precludes the need for bending over to wring the mod head, saves space through use of a twisting action, provide for simplicity of operation and construction, and to operate with relatively low exertion. In doing so, embodiments of the present invention advantageously overcome one or more drawbacks associated with conventional mop head wringing mechanisms.

In one embodiment of the present invention, a mop head wringing mechanism comprises a first sleeve, a second sleeve, a slip member and a control member. The first sleeve has a helical-shaped spline extending at least partially around an external face thereof. The second sleeve is slideably engaged over the first sleeve and has a spline engaging portion in constrained engagement with the helical-shaped spline of the first sleeve whereby translation of the second sleeve with respect to the first sleeve causes rotation of the second sleeve with respect to the first sleeve. The slip member is engaged with the second sleeve, is substantially constrained from lateral movement with respect to the second sleeve and is engaged with the second sleeve in a manner enabling rotation of the second sleeve with respect to the slip member. The control member is coupled to the slip member such that movement of the control member from a first position to a second position causes the second sleeve to translate from an at-rest position to a displaced position whereby the second sleeve rotates from an at-rest angular position relative to the first sleeve to a displaced angular position.

In another embodiment of the present invention, a mop comprises an elongated handle assembly including a handle and a first sleeve attached to a first end portion of the handle, a second sleeve slideably engaged over the first sleeve, a slip member engaged with the second sleeve and a control member movably attached to the handle adjacent a second end portion of the handle. The first sleeve is in substantially fixed position with respect to the first end portion of the handle and has a helical-shaped spline extending at least partially around an external face thereof. The second sleeve is slideably engaged over the first sleeve. The second sleeve has a spline engaging portion in constrained engagement with the helical-shaped spline of the first sleeve whereby translation of the second sleeve with respect to the first sleeve causes rotation of the second sleeve with respect to the first sleeve. The slip member is engaged with the second sleeve, is substantially constrained from lateral movement with respect to the second sleeve and is engaged with the second sleeve in a manner enabling rotation of the second sleeve with respect to the slip member. The control member is coupled to the slip member such that movement of the control member from a first position to a second position causes the second sleeve to translate from an at-rest position to a displaced position whereby the second sleeve rotates from an at-rest angular position relative to the first sleeve to a displaced angular position.

In another embodiment of the present invention, a mop comprises a handle, a first sleeve, a second sleeve, a collar and a control member. The handle has a first end portion and a second end portion. The first sleeve is fixedly attached to the handle at the first end portion of the handle and has a helical-shaped spline extending at least partially around an external face thereof. The second sleeve is slideably engaged over the first sleeve and has a spline engaging portion in constrained engagement with the helical-shaped spline of the first sleeve whereby translation of the second sleeve with respect to the first sleeve causes rotation of the second sleeve with respect to the first sleeve. The collar is rotatably engaged with the second sleeve and is substantially constrained from lateral movement with respect to the second sleeve. The control member is movably attached to the handle adjacent the second end portion of the handle and is coupled to the collar such that movement of the control member from a first position to a second position causes the second sleeve to translate from an at-rest position to a displaced position whereby the second sleeve rotates from an at-rest angular position relative to the first sleeve to a displaced angular position.

Turning now to specific aspects of the present invention, in at least one embodiment, a mop comprises a string mop head including a first attachment member, a second attachment member and a plurality of strings connected between the first attachment member and the second attachment member. The first attachment member is engaged with a mop head engaging portion exposed at a terminal end portion of the first sleeve and the second attachment member is engaged with the second sleeve.

In at least one embodiment of the present invention, the slip member includes a collar rotatably engaged with the second sleeve. The collar is substantially constrained from lateral movement with respect to the second sleeve and the control member is coupled to the collar through a rigid linkage member.

In at least one embodiment of the present invention, a mop head wringing mechanism comprises a rigid linkage member connected between the slip member and the control member.

In at least one embodiment of the present invention, the spline engaging portion of the second sleeve includes a helical shaped channel within an interior surface of the second sleeve and at least a portion of the helical shaped spline is engaged with at least a portion of the helical shaped channel.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
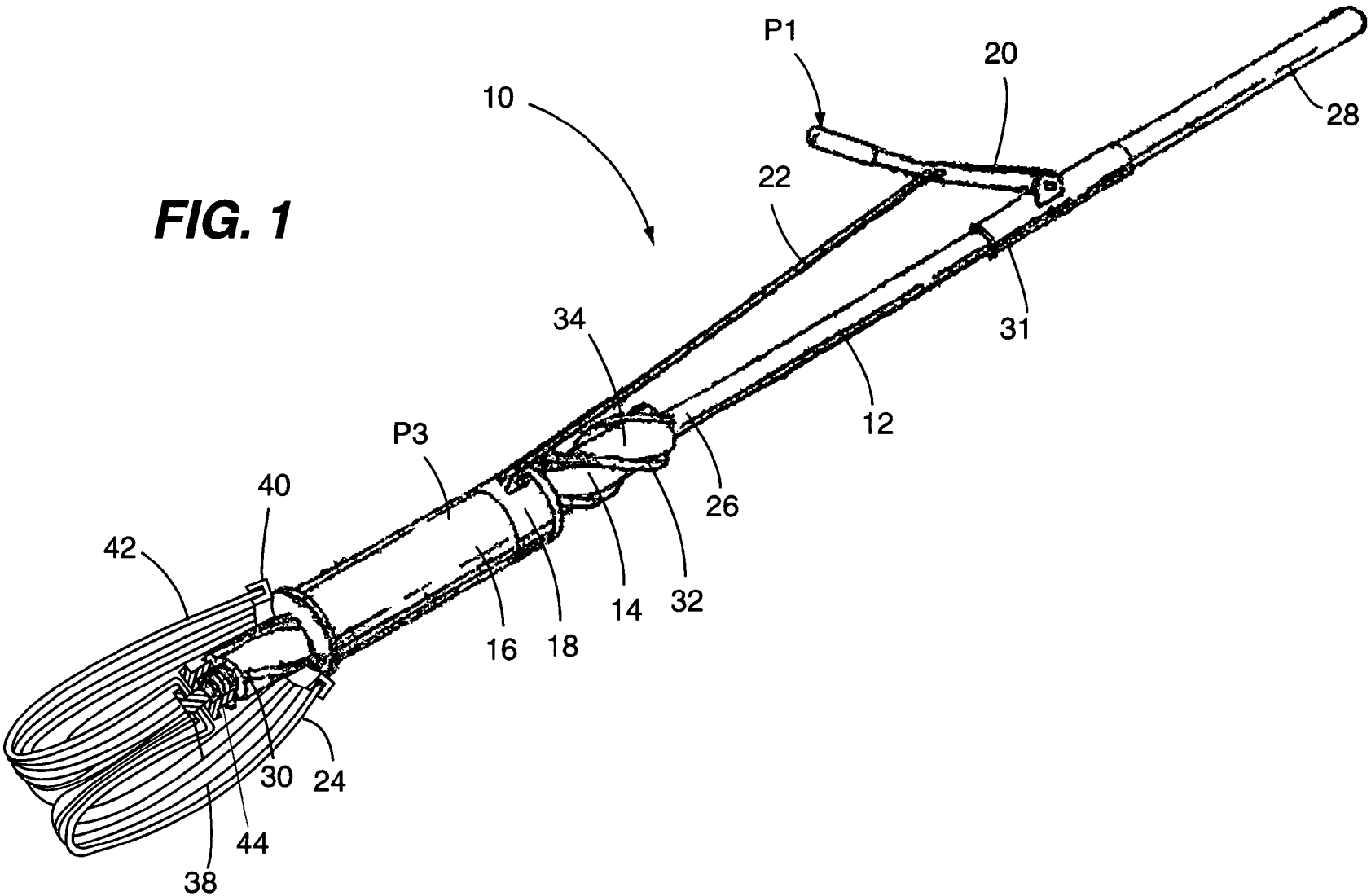
FIG. 1 depicts an embodiment of a mop in accordance with the present invention, wherein a mop head of the mop is in a use position.
Figure 2:
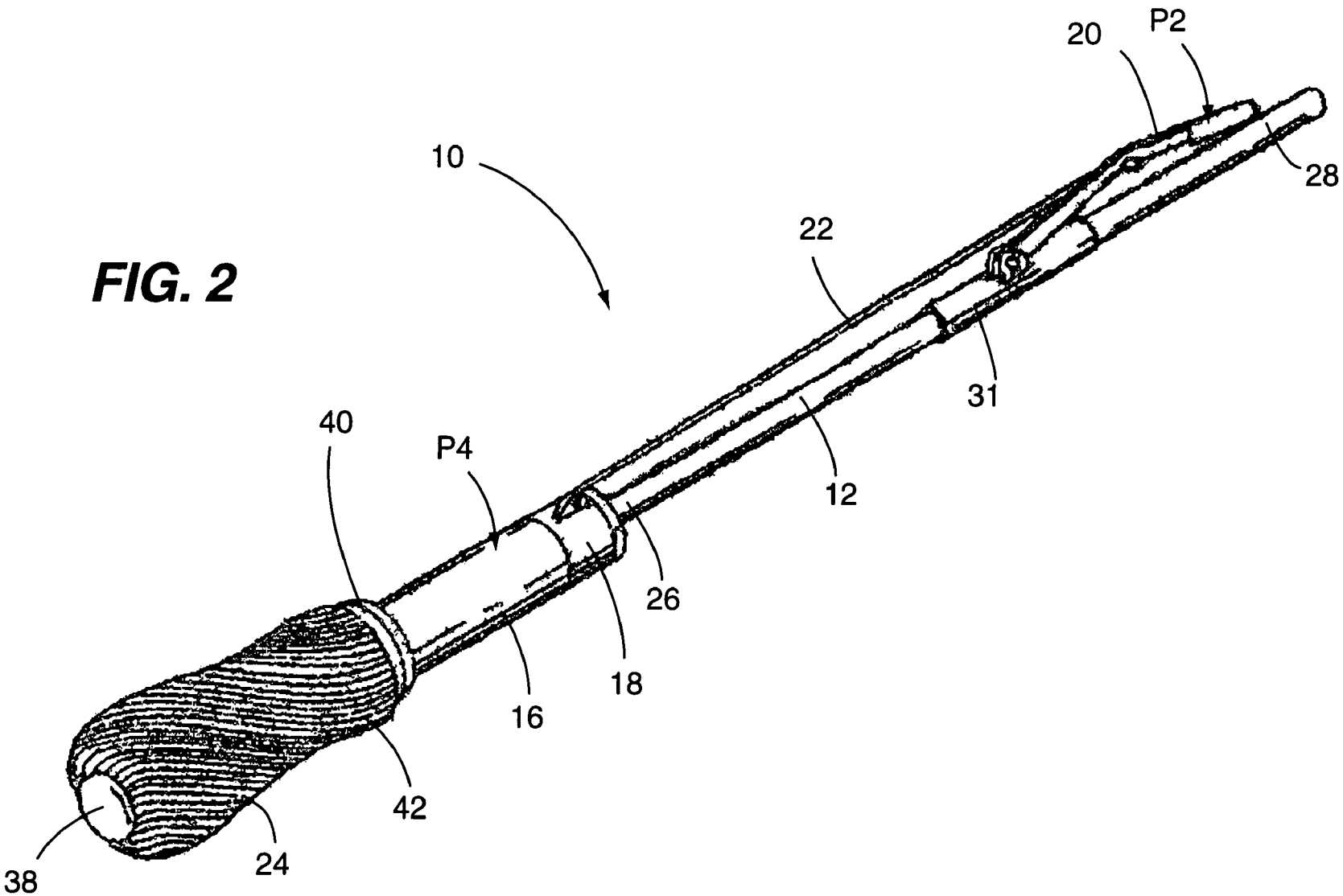
FIG. 2 depicts the mop of FIG. 1 with the mop head in a wringed position.

FIGS. 1 and 2 depict an embodiment of a mop in accordance with the present invention, which is referred to herein as the mop 10. The mop 10 includes a handle 12, a first sleeve 14, a second sleeve 16, a collar 18, a control member 20, a rigid linkage member 22 and a string mop head. As will be further discussed below, the handle 12, the first sleeve 14, the second sleeve 16, the collar 18, the control member 20, the rigid linkage member 22 and the string mop head 24 are interconnected in a manner enabling the mop 10 to advantageously overcome one or more drawbacks associated with conventional mop head wringing mechanisms.

The first sleeve 14 is fixedly attached to the handle 12 at a first end portion 26 of the handle 12. It is disclosed herein that the handle 12 may be engaged with the first sleeve substantially close to a terminal end portion 30 of the first sleeve, or may even extend through the terminal end portion 30 of the first sleeve 14. In accordance with the present invention, an elongated handle assembly includes the handle 12 and the first sleeve 14. The first sleeve is attached to the first end portion 26 of the handle 12 and is in substantially fixed position with respect to the first end portion 26 of the handle 12.

The second sleeve 16 is slideably engaged over the first sleeve 14. The collar 18 is rotatably engaged with the second sleeve 16. The collar 18 is one embodiment of a slip member in accordance with the present invention. Other embodiments of such a slip member are contemplated herein. One example of the slip member is a member extending through a slot extending partially around a circumference of the second sleeve 16 and engaged within a slot extending longitudinally within the handle 12. In this manner, the slip member is disclosed herein to be substantially constrained from lateral movement with respect to the second sleeve 16 and be engaged with the second sleeve 16 in a manner enabling rotation of the second sleeve 16 with respect to the slip member.

The control member 20 is pivotally attached to the handle 12 adjacent a second end portion 28 of the handle 12 and is coupled to the collar 18 through the rigid linkage member 22. As depicted, the control member 20 is preferably, but not necessarily, pivotally attached to the handle 12 through an attachment device 31 that is engaged over and attached to the handle 12. Optionally, the control member 20 may be attached directly to the handle 12. Preferably, the rigid linkage member 22 is pivotally attached to the collar 18 and the control member 20. In one embodiment, the control member 20 is a lever. Optionally, the control member 20 may be slidably attached to the handle 12 in a manner enabling the control member 20 to slide along a length of the handle 12.

Figure 3:
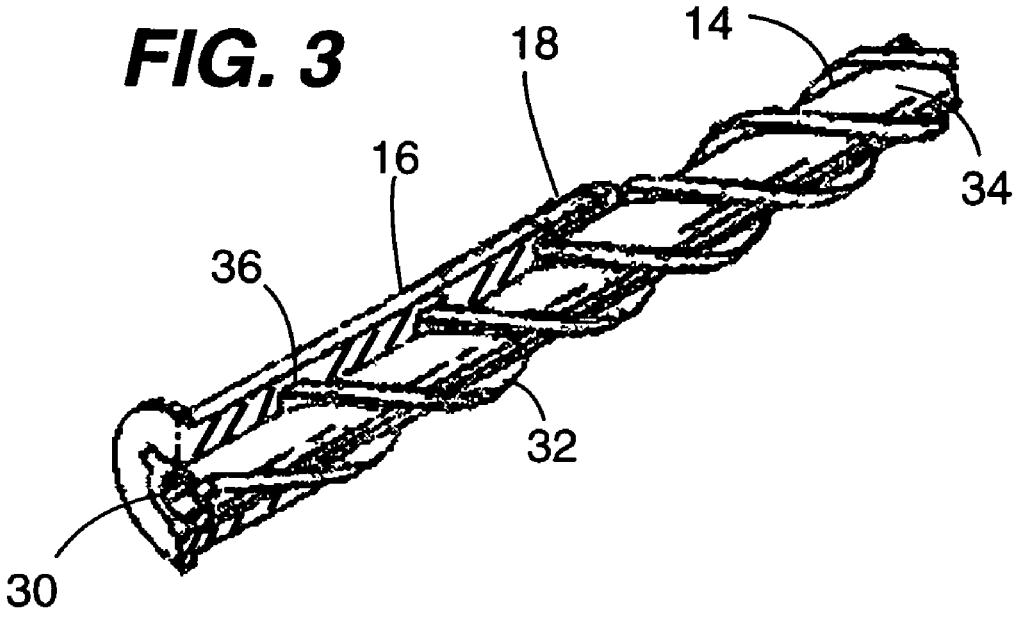
FIG. 3 is a partial fragmentary view of a sleeve assembly in accordance with the present invention.

Referring now to FIGS. 1-3, the first sleeve 14 has a helical-shaped spline 32 extending at least partially around an external face 34 thereof. The second sleeve 16 has a helical shaped channel 36 within an interior surface of the second sleeve 16. A least a portion of the helical shaped spline 32 is engaged with at least a portion of the helical shaped channel 36. Accordingly, the helical shaped channel 36 is an embodiment of a spline engaging portion that is in constrained engagement with the helical-shaped spline 34 of the first sleeve 14. Through such constrained engagement an in association with a chosen pitch of the helical shaped spline 32, translation of the second sleeve 16 with respect to the first sleeve 14 causes rotation of the second sleeve 16 with respect to the first sleeve 14. For example, in use, movement of the control member 20 from a first position P1 (FIG. 1) to a second position P2 (FIG. 2) applies a translating force on the second sleeve 16 via the collar 18, which causes the second sleeve 16 to translate from an at-rest position P3 (FIG. 1) to a displaced position P4 (FIG. 2). During translation of the second sleeve 16 from the at-rest position P3 to the displaced position P4, the second sleeve 16 rotates from an at-rest angular position (e.g., 0-degrees relative to an angular reference mark) relative to the first sleeve 14 to a displaced angular position (e.g., 180 degrees relative to the angular reference mark).

Figure 4:
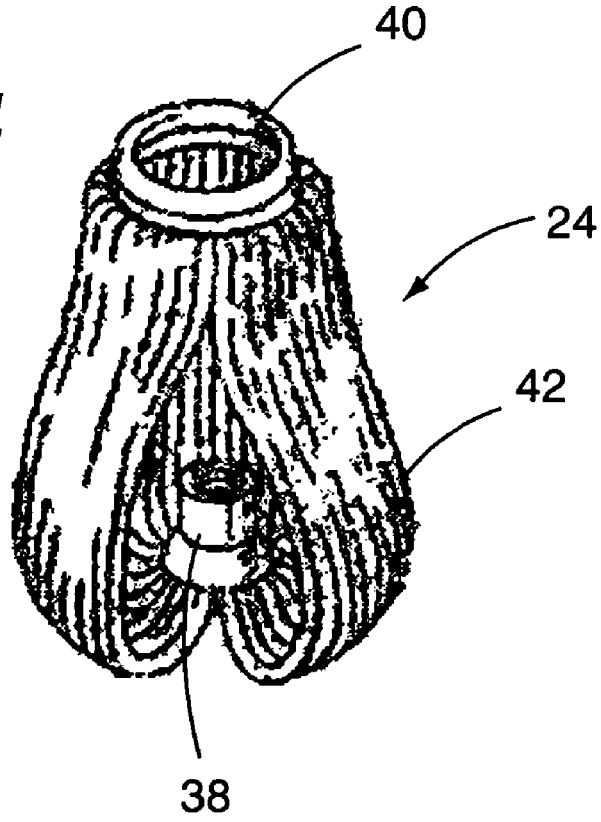
FIG. 4 depicts an embodiment of a mop head in accordance with the present invention.

Referring to FIGS. 1, 2 and 4, the string mop 24 includes a first attachment member 38, a second attachment member 40 and a plurality of strings 42. The strings 42 are connected between the first attachment member 38 and the second attachment member 40. The first attachment member 38 is engaged with a mop head engaging portion 44 exposed at the terminal end portion 30 of the first sleeve 14 and the second attachment member 16 is engaged with the second sleeve 16. The first attachment member 38 and the second attachment member 40 are engaged with the respective structures in a generally fixed manner such that relative angular movement is limited between the first attachment member 38 and the mop head engaging portion 44 and between the second attachment member 16 and the second sleeve 16. For example, mating indexing features may be provided for providing such limited movement between the first attachment member 38 and the mop head engaging portion 44 and between the second attachment member 16 and the second sleeve 16. Accordingly, movement of the control member handle 12 from the such that rotational force associated with angular rotation of the second sleeve 16 relative to the first sleeve 14 may be applied between the first attachment member 38 and the second attachment member 40 thereby providing for wringing of the mod head 24.

In use, the control member 20 is moved from the first position P1 to the second position P2. Correspondingly, this causes the second sleeve 16 to translate from the at-rest position P3 to the displaced position P4. Translation of the second sleeve causes the strings of the mop head 24 to gather around the first sleeve 14 and causes the second sleeve 16 to rotate from the at-rest angular position to the displaced angular position. The combination of the strings 42 of the mop head 24 gathering around the first sleeve 14 and the twisting of the second sleeve 16 to rotate from the at-rest angular position to the displaced angular position serves to wring the strings 42 around the second sleeve 16 thereby squeezing liquid from the strings 42.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A mop head wringing mechanism, comprising: a first sleeve having a helical-shaped spline extending at least partially around an external face thereof; a second sleeve slideably engaged over the first sleeve, wherein the second sleeve has a spline engaging portion in constrained engagement with the helical-shaped spline of the first sleeve whereby translation of the second sleeve with respect to the first sleeve causes rotation of the second sleeve with respect to the first sleeve; a slip member engaged with the second sleeve, wherein the slip member is substantially constrained from lateral movement with respect to the second sleeve and is engaged with the second sleeve in a manner enabling rotation of the second sleeve with respect to the slip member; and a control member coupled to the slip member such that movement of the control member from a first position to a second position causes the second sleeve to translate from an at-rest position to a displaced position whereby the second sleeve rotates from an at-rest angular position relative to the first sleeve to a displaced angular position further comprising: a rigid linkage member connected between the slip member and the control member.

2. The mop head wringing mechanism of claim 1 wherein: the slip member includes a collar rotatably engaged with the second sleeve; the collar is substantially constrained from lateral movement with respect to the second sleeve; and the control member is coupled to the collar through a rigid linkage member.

3. The mop head wringing mechanism of claim 1 further comprising: a rigid linkage member connected between the slip member and the control member; wherein the slip member includes a collar rotatably engaged with the second sleeve; wherein the collar is substantially constrained from lateral movement with respect to the second sleeve; wherein the control member is coupled to the collar through a rigid linkage member; wherein the first sleeve includes a mop head attachment portion at a first end portion thereof and a handle engaging portion between the first end portion thereof and a second end portion thereof; the spline engaging portion of the second sleeve includes a helical shaped channel within an interior surface of the second sleeve; and at least a portion of the helical shaped spline is engaged with at least a portion of the helical shaped channel.

4. A mop, comprising: an elongated handle assembly including a handle and a first sleeve attached to a first end portion of the handle, wherein the first sleeve is in substantially fixed position with respect to the first end portion of the handle and wherein the first sleeve has a helical-shaped spline extending at least partially around an external face thereof; a second sleeve slideably engaged over the first sleeve, wherein the second sleeve has a spline engaging portion in constrained engagement with the helical-shaped spline of the first sleeve whereby translation of the second sleeve with respect to the first sleeve causes rotation of the second sleeve with respect to the first sleeve; a slip member engaged with the second sleeve, wherein the slip member is substantially constrained from lateral movement with respect to the second sleeve and is engaged with the second sleeve in a manner enabling rotation of the second sleeve with respect to the slip member; and a control member movably attached to the handle adjacent the second end portion of the handle and coupled to the slip member such that movement of the control member from a first position to a second position causes the second sleeve to translate from an at-rest position to a displaced position whereby the second sleeve rotates from an at-rest angular position relative to the first sleeve to a displaced angular position.

5. The mop of claim 4, further comprising: a string mop head including a first attachment member, a second attachment member and a plurality of strings connected between the first attachment member and the second attachment member, wherein the first attachment member is engaged with a mop head engaging portion exposed at a terminal end portion of the first sleeve and wherein the second attachment member is engaged with the second sleeve.

6. The mop of claim 4 wherein: the slip member includes a collar rotatably engaged with the second sleeve; the collar is substantially constrained from lateral movement with respect to the second sleeve; and the control member is coupled to the collar through a rigid linkage member.

7. The mop of claim 4, further comprising: a rigid linkage member connected between the slip member and the control member.

8. The mop of claim 4 wherein: the spline engaging portion of the second sleeve includes a helical shaped channel within an interior surface of the second sleeve; and at least a portion of the helical shaped spline is engaged with at least a portion of the helical shaped channel.

9. The mop of claim 4, further comprising: a rigid linkage member connected between the slip member and the control member; and a string mop head including a first attachment member, a second attachment member and a plurality of strings connected between the first attachment member and the second attachment member; wherein the first attachment member is engaged with a mop head engaging portion exposed at a terminal end portion of the first sleeve; wherein the second attachment member is engaged with the second sleeve; wherein the slip member includes a collar rotatably engaged with the second sleeve; wherein the collar is substantially constrained from lateral movement with respect to the second sleeve; wherein the control member is coupled to the collar through a rigid linkage member; wherein the spline engaging portion of the second sleeve includes a helical shaped channel within an interior surface of the second sleeve; and wherein at least a portion of the helical shaped spline is engaged with at least a portion of the helical shaped channel.

10. A mop, comprising: a handle having a first end portion and a second end portion; a first sleeve fixedly attached to the handle at the first end portion of the handle, wherein the first sleeve has a helical-shaped spline extending at least partially around an external face thereof; a second sleeve slideably engaged over the first sleeve, wherein the second sleeve has a spline engaging portion in constrained engagement with the helical-shaped spline of the first sleeve whereby translation of the second sleeve with respect to the first sleeve causes rotation of the second sleeve with respect to the first sleeve; a collar rotatably engaged with the second sleeve, wherein the collar is substantially constrained from lateral movement with respect to the second sleeve; and a control member movably attached to the handle adjacent the second end portion of the handle and coupled to the collar such that movement of the control member from a first position to a second position causes the second sleeve to translate from an at-rest position to a displaced position whereby the second sleeve rotates from an at-rest angular position relative to the first sleeve to a displaced angular position.

11. The mop of claim 10, further comprising: a string mop head including a first attachment member, a second attachment member and a plurality of strings connected between the first attachment member and the second attachment member, wherein the first attachment member is engaged with a mop head engaging portion exposed at a terminal end portion of the first sleeve and wherein the second attachment member is engaged with the second sleeve.

12. The mop of claim 11 wherein: the slip member includes a collar rotatably engaged with the second sleeve; the collar is substantially constrained from lateral movement with respect to the second sleeve; and the control member is coupled to the collar through a rigid linkage member.

13. The mop of claim 12, further comprising: a rigid linkage member connected between the slip member and the control member.

14. The mop of claim 13 wherein: the spline engaging portion of the second sleeve includes a helical shaped channel within an interior surface of the second sleeve; and at least a portion of the helical shaped spline is engaged with at least a portion of the helical shaped channel.

* * * * *